US007784472B2

(12) United States Patent
Hochi

(10) Patent No.: US 7,784,472 B2
(45) Date of Patent: Aug. 31, 2010

(54) DISPOSABLE WIG

(75) Inventor: Hiroshi Hochi, Tokyo (JP)

(73) Assignee: Propia Co., Ltd., Tokyo (JP)

( * ) Notice: Subject to any disclaimer, the term of this patent is extended or adjusted under 35 U.S.C. 154(b) by 295 days.

(21) Appl. No.: 10/574,294

(22) PCT Filed: Oct. 5, 2004

(86) PCT No.: PCT/JP2004/014645

§ 371 (c)(1),
(2), (4) Date: Mar. 31, 2006

(87) PCT Pub. No.: WO2005/032291

PCT Pub. Date: Apr. 14, 2005

(65) Prior Publication Data

US 2007/0119468 A1 May 31, 2007

(30) Foreign Application Priority Data

Oct. 6, 2003 (JP) ..... 2003-347416

(51) Int. Cl.
*A41G 3/00* (2006.01)

(52) U.S. Cl. ..... 132/53

(58) Field of Classification Search ..... 132/201, 132/53–56

See application file for complete search history.

(56) References Cited

U.S. PATENT DOCUMENTS

| | | | | |
|---|---|---|---|---|
| 4,456,019 | A * | 6/1984 | Finamore | 132/201 |
| 4,517,999 | A * | 5/1985 | Finamore | 132/53 |
| 6,135,122 | A * | 10/2000 | Campbell et al. | 132/201 |
| 2001/0037813 | A1* | 11/2001 | Ra | 132/53 |
| 2004/0237987 | A1* | 12/2004 | Gold | 132/201 |

FOREIGN PATENT DOCUMENTS

| | | | |
|---|---|---|---|
| JP | 55-022376 | U | 2/1980 |
| JP | 02-066632 | U | 5/1990 |
| JP | 04-361604 | A | 12/1992 |
| JP | 4-361604 | A | 12/1992 |
| JP | 2001-089921 | A | 4/2001 |

OTHER PUBLICATIONS

Microfilm of the specification and drawings annexed to the request of Japanese Utility Model Application No. 105824/1978 (Laid-open No. 22376/1980) Kaneka Corp; Feb. 13, 1980.

Microfilm of the specification and drawings annexed to the request of Japanese Utility Model Application No. 141990/1988 (Laid-open No. 66632/1990) Artnature Inc.; May 21, 1990.

Chinese Office Action dated Jun. 20, 2008 and English translation thereof issued in a counterpart Chinese Application No. 200480029188.7.

Australian Office Action dated Mar. 12, 2009, issued in counterpart Australian Patent Application No. 2004277820.

Chinese Office Action dated Dec. 26, 2008 and English translation thereof issued in a counterpart Chinese Application No. 200480029188.7.

Chinese Office Action dated Jun. 26, 2009 and English translation thereof issued in a counterpart Chinese Application No. 200480029188.7.

* cited by examiner

*Primary Examiner*—Robyn Doan
*Assistant Examiner*—Rachel R Steitz
(74) *Attorney, Agent, or Firm*—Frishauf, Holtz, Goodman & Chick, P.C.

(57) ABSTRACT

A disposable wig has a base 1 formed of an extremely thin sheet, hair segments 3 implanted onto the base and an adhesive layer 7 formed on the underside of the base. The thickness of the base is of the order of microns (μ). The adhesive layer is uniformly formed on the entire underside of the base with such a thickness that there is a little unevenness with projected portions 9 and remaining portions. The projected portions engaging the root portions 5 of the implanted hair segments protruding from the underside of the base, and are raised toward the surface side of the base when the wig is fitted onto a human skin. When the wig is fitted onto scalp 13, the unevenness at the underside of the base is depressed and raised by the surface of the scalp so that, at the base surface, the projected portions engaging the root portions of the implanted hair segments are raised when compared with the remaining portions.

14 Claims, 3 Drawing Sheets

DISPOSABLE WIG

This application is a U.S. National Phase Application under 35 USC 371 of International Application PCT/JP2004/014645 filed Oct. 5, 2004.

FIELD OF THE ART

The present invention relates to an wig and more particularly to a disposable wig.

BACKGROUND OF THE ART

A wig has been manufactured by handwork and, therefore, is expensive. There has been no concept that a wig is used once or only several times and thrown away.

The wig has been manufactured by handwork in such a manner that a hair segment to be implanted is folded in two, which is one by one implanted by hand onto a thick base formed into a three-dimensional shape, for example. When one folded hair segment is implanted, it looks as if two hairs are implanted. In another operation, a bundle of several folded hair segments have been implanted at one time.

A disposable wig has first been proposed by the present inventor, one example of which is disclosed in the following patent document 1.

Patent Document 1: Japanese Patent Application No. 1999-264131

DISCLOSURE OF THE INVENTION

Problems to be Solved by the Invention

Such a prior art handwork hair-implantation is extremely inefficient, because it would take about three weeks to implant 20,000 hair segments, for example, to the utmost. In addition, when a wig is manufactured in foreign countries in order to save labor costs, it tends to increase inferior products and reduce a yield of production.

The inventors have made some attempts to form an adhesive layer on the underside of the base by coating and spraying methods, but they have ended in failure because the adhesive layer formed by such methods would be too thick or have uneven surface.

If the base, including the adhesive layer formed on the underside of the base, should not be formed as a thin skin, it provides a remarkable level difference when it is fitted onto a human skin. It looks really like a wig and could easily be recognized as artificial hair.

Further, if the surface of the adhesive layer is not even, the fitting surface of the wig tends to wrinkle, resulting in unnatural appearance.

Still further, if the surface of the adhesive layer is not even, the adhesive strength would not be uniform, so that it becomes easier to be partially peeled off.

The purpose of the present invention is to overcome the above-described problems and more specifically to provide a wig that is hardly recognized as artificial hair and can be thrown away after it has been deteriorated with time.

Means for Solving the Problems

To achieve the above objects, a disposable wig according to the present invention comprises a base formed of an extremely thin sheet, hair segments implanted onto the base and an adhesive layer formed on the underside of the base, characterized in that the thickness of the base is of the order of microns (μ), the adhesive layer is formed on the entire underside of the base with a uniform thickness, having projected portions and remaining portions, the projected portions engaging the root portions of the implanted hair segments protruding from the underside of the base, and the projected portions are raised toward the surface side of the base when the wig is fitted onto a human skin.

The disposable wig defined in claim 1 may further be characterized in that the thickness of the adhesive layer is in a range of up to about 20 times greater than the thickness of the base.

The disposable wig defined in claim 1 may further be characterized in that the projected portions of the adhesive layer have height of 80 microns.

Advantages of the Invention

When the wig is fitted onto a substantially flat surface of a human skin (such as scalp), the projected portions at the underside of the base become substantially flat because the entire underside of the base is in planar contact with the flat surface of the scalp, so that the projected portions will now appear at the top surface of the base. Accordingly, at the base surface, the projected portions that engage the root portions of the implanted hair segments are raised when compared with the remaining (recessed) portions.

When the entire top surface of the base becomes so rugged with the projected portions and the remaining portions, light that hits the base is irregularly reflected so that the base will not glisten and the wig is hard to be distinguished from true hair.

In addition, due to a reversal phenomenon of the rugged underside of the base (that is a phenomenon wherein the underside of the base having the downward projected portions becomes flat and the top surface of the base becomes rugged with upward projected portions), the root portions of the implanted hair segments are urged by the scalp, through the thin adhesive layer, toward the surface side of the base, thereby reinforcing the fixing of the implanted hair segments and prevent the implanted hair segments from being removed from the base.

PREFERRED EMBODIMENTS OF INVENTION

Figure 1:
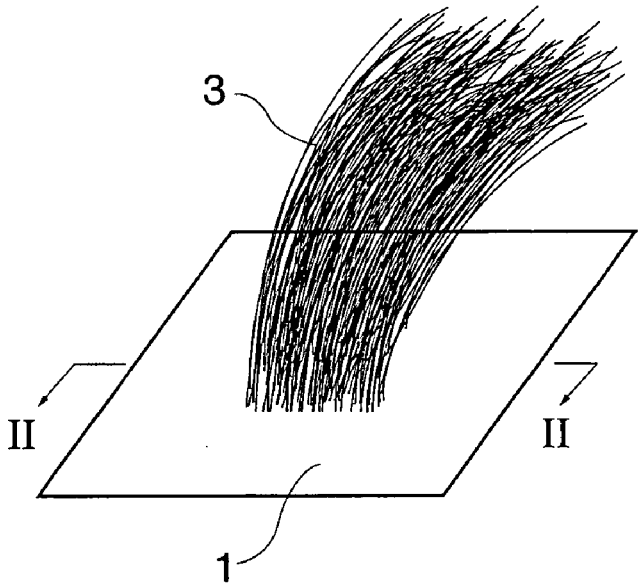
FIG. 1 is a perspective view showing a disposable wig according to an embodiment of the present invention.
Figure 2:
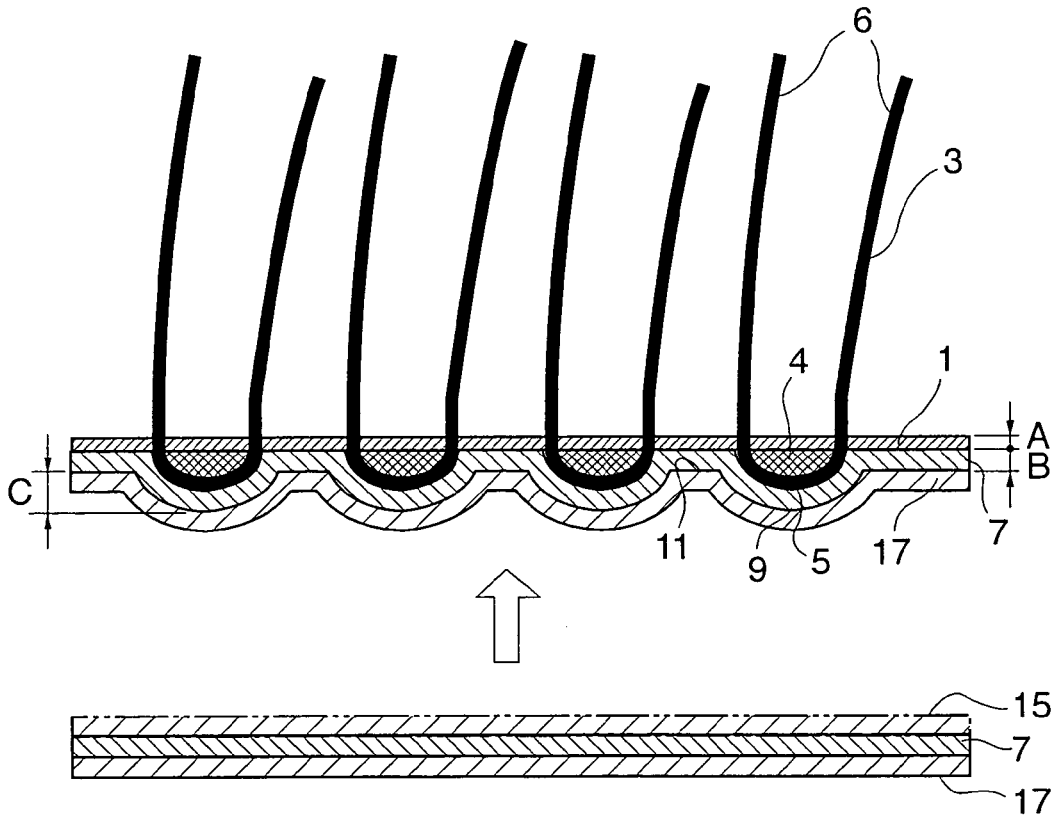
FIG. 2 is an enlarged view taken along II-II line in FIG. 1.

Next, a disposable wig according to the present invention will be described in more detail in reference to the accompanying drawings showing an embodiment thereof. For the sake of convenience, parts having the same function are indicated by the same reference numerals and explanation thereof will be omitted. A reference numeral 1 indicates a base that is formed of an extremely thin sheet having thickness substantially equal to that of a human skin (for example, 30 microns). The base 1 is made from elastic, colorless, transparent material such as polyurethane, and formed as substantially a flat sheet. Reference numerals 3 indicate hair segments implanted onto the bases 1 that are made from polyester fiber. The hair segments 3 are implanted by V-implanting method, for example. A reference numeral 4 indicates adhesive that is applied in a dotty pattern to a root portion 5 of each hair segment 3 by using a pin, not shown, when the hair segment 3 is implanted, so as to secure the root portion 5 to the underside of the base 1. This reinforces the fitting of the implanted hair segment 3 onto the base 1 and supports the upstanding condition of the hair segment 3. The root portion 5 of the implanted hair segment 3 is projected from the underside of the base 1. Reference numerals 6 indicate free ends of the implanted hair segment 3. A reference numeral 7 indicates an adhesive layer that is formed on the entire underside of the base 1 with a uniform thickness. The thickness B of the adhesive layer 7 is formed in such a manner that there is a rugged underside with projected portions 9 that engage the root portions 5 and the remaining portions (recessed portions 11).

The adhesive layer 7 is formed by a transfer process from acryl-based adhesive. More particularly, an acryl-based adhesive sheet with release papers 15, 17 at opposite sides thereof is prepared and one 15 of the release papers (PET) is removed so that the exposed surface of the adhesive is adhered to the entire underside of the base 1. For use, the other release paper 17 is removed so that the base is fitted onto a desired portion of the scalp or other human body.

Table 1 shows examples of the thickness B of the adhesive layer 7, ratios between them and the thickness A of the base 1 (B/A ratios), examples of the heights C of the projected portions 9 from the surface of the recessed portions 11 and ratios between them and the thickness A of the base 1 (C/A ratios). The actual numerical values have been rounded to two decimal places and the resulting rounded values are shown Table 1.

TABLE 1

| Example | Thickness A of Base (μ) | Thickness B of Adhesive Layer (μ) | B/A Ratio | Height C of Projected Portions (μ) | C/A Ratio |
|---|---|---|---|---|---|
| 1 | 30 | 40 | 1.3 | 80 | 2.7 |
| 2 | 30 | 60 | 2 | 80 | 2.7 |
| 3 | 30 | 120 | 4 | 80 | 2.7 |
| 4 | 30 | 150 | 5 | 80 | 2.7 |
| 5 | 30 | 200 | 6.7 | 80 | 2.7 |

The B/A ratios are proportional to the thickness B of the adhesive layer 7 because the thickness A of the base 1 is constant, but all examples have the constant C/A ratio because the adhesive layer 7 has the uniform thickness B and the constant height C. This provides the following results.

Figure 3:
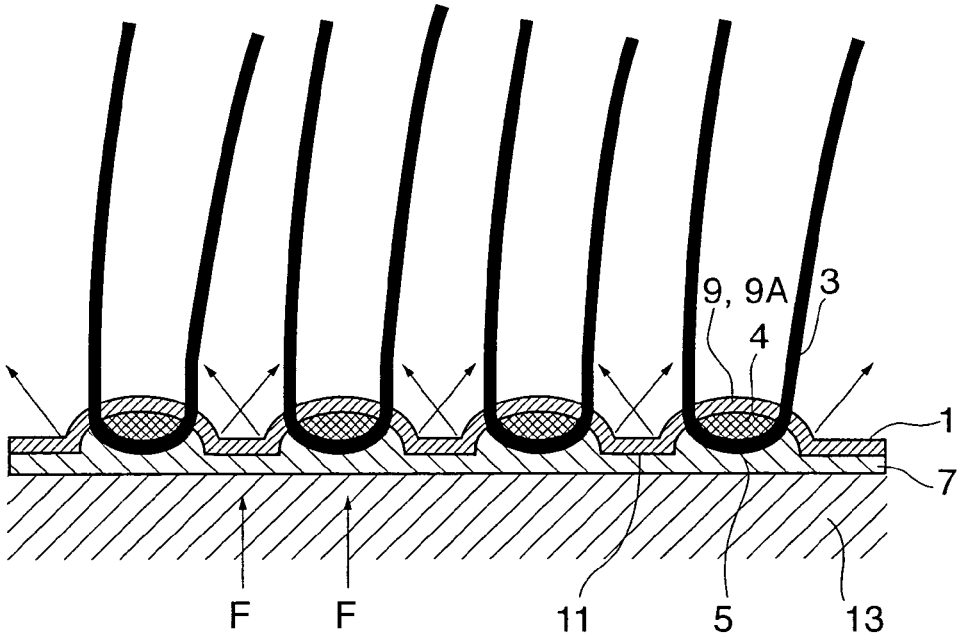
FIG. 3 is a view showing a disposable wig according to the present invention when it is fitted onto a human scalp.

First, when the wig is fitted onto a human skin (such as the scalp 13), the rugged underside of the base becomes into press-contact with the scalp 13 so that the projected portions 9 now appear at the surface side of the base, as shown in FIG. 3.

Accordingly, at the surface of the base 1, the projected portions 9 that engage the root portions 5 of the implanted hair segments 3 are raised when compared with the recessed portions 11. This is called a reversal phenomenon of the unevenness (that is a phenomenon wherein the projected portions originally directing downward becomes one directing upward). This is caused by the fact that the base 1 and the adhesive layer 7 are both formed to have extremely thin, but uniform thickness. The projected portions 9 that become raised are shown by reference numerals 9A.

When the entire surface of the base 1 becomes so rugged with the projected portions and the remaining portions, light (shown by an arrow) that hits the base 1 is irregularly reflected so that the base 1 will not glisten and the wig is hard to be distinguished from true hair.

Due to the above-described reversal phenomenon of the projected portions which can be seen when the wig is fitted onto the human body, as shown by the arrows F, the implanted hair segments 3 become into press-contact with the scalp 13, through the thin adhesive layer 7, toward the surface side of the base 1, thereby reinforcing the fixing of the implanted hair segments 3 and prevent the implanted hair segments 3 from being removed or epilated from the base 1.

As shown in FIG. 3, the portions (the recessed portions 11) at which no hair segments 3 are implanted are well transparent because the base 1 and the adhesive layer 7 are both extremely thin, so that the scalp 13 beneath these portions 11 can be seen therethrough. This will also contribute to the fact that the wig is hard to be distinguished from true hair.

The adhesive layer is formed by the transfer process and has constant C/A ratio, so that the adhesive layer having uniform but extremely thin thickness may be mechanically and industrially produced.

The base 1 formed of elastic material shrinks after the wig is fitted onto the human body, so that there is an advantage that the portions of hair-implantation becomes inconspicuous.

Once integrally fitted on the human skin, anyone wearing the wig is free to scratch the head, brush, shampoo while wigged, swim, etc. without no anxiety for displacement of the wig. Moreover, the wig may be tightly fitted with no clearance or gap between the wig and the skin, so that it has improved compatibility to natural hair and any one holds no strange feelings when touching the wig. In addition, because there is no gap between the wig and the skin, no sound may be heard when tapping the wig. Therefore, the user will be free from any uneasy and stress.

In comparison with the conventional wig that is placed onto the head and connected with the own hair, the wig according to the present invention is in direct contact with the skin and, therefore, is applicable to any desired skin area even if such has no own hair, including private parts of atrichosis. In addition, there is no load to the own hair.

The present invention is not limited to the above-described embodiment. For example, it should be understood that numerical values designating the thickness of the base 1, the thickness of the adhesive layer 7 and the height of the projected portions 9 in the above-described embodiment are only examples and may be changed without departing the gist of the present invention. For example, the thickness A of the base 1, the thickness B of the adhesive layer 7 and the height C of the projected portions 9 may be changed as shown in Table 2.

TABLE 2

| Example | Thickness A of Bae (μ) | Thickness B of Adhesive Layer (μ) | B/A Ratio | Height C of Projected Portions (μ) | C/A Ratio |
|---|---|---|---|---|---|
| 6 | 10 | 40 | 4 | 80 | 8 |
| 7 | 10 | 60 | 6 | 80 | 8 |
| 8 | 10 | 120 | 12 | 80 | 8 |
| 9 | 10 | 150 | 15 | 80 | 8 |
| 10 | 10 | 200 | 20 | 80 | 8 |

Variations of B/A ratios shown in Table 1 or Table 2 may be selectively used depending upon the skin area and condition to which the wig or the adhesive sheet with the implanted artificial hair according to the present invention is applied.

For example, when applied to a sudoresis or a skin area of greater sebum secretion, a wig having a greater B/A ratio is preferred, because the adhesive layer 7 absorbs sweat and sebum. When applied to a skin area at which own hair is to be grown, a wig having a smaller B/A ratio is used to prevent interruption of growth of the own hair.

The tensile strength of the base 1 increases with its thickness, whereas its compatibility to skin increases as it becomes thin. Accordingly, when applied to a skin area such as an eyebrow and mustache, for example, compatibility is required rather than tensile strength, and a wig having a thin base 1 is preferred.

How to implant the hair segments is optional.

INDUSTRIAL APPLICABILITY

The present invention may be used as a wig or an adhesive sheet with implanted artificial hair of a completely novel type.

The invention claimed is:

1. A disposable wig comprising:

a non-customized base formed of an elastic thin sheet having a thickness on the order of microns (μ), hair segments implanted onto said base and having root portions protruding from an underside of said base, and an adhesive layer formed on an entirety of said underside of said base with a uniform thickness, wherein said adhesive layer comprises: (i) projected portions which engage the root portions of the implanted hair segments protruding from said underside of said base, and (ii) remaining portions, and said projected portions become reversed and are raised toward a surface side of said base when said wig is fitted onto a human skin, and wherein the uniform thickness of said adhesive layer is in a range of up to about 20 times greater than the thickness of said base.

2. The disposable wig as defined in claim 1, wherein said projected portions of said adhesive layer have a height of about 80 microns.

3. The disposable wig as defined in claim 1, wherein an adhesive is applied in a dotty pattern to the root portions of the implanted hair segments so as to secure the root portions to the underside of the base.

4. The disposable wig as defined in claim 1, wherein the base is made from a colorless and transparent material.

5. The disposable wig as defined in claim 4, wherein the material of the base comprises polyurethane.

6. The disposable wig as defined in claim 1, wherein the base is formed as substantially a flat sheet.

7. The disposable wig as defined in claim 1, wherein the hair segments comprise a polyester fiber.

8. The disposable wig as defined in claim 1, wherein the adhesive layer comprises an acryl-based adhesive.

9. The disposable wig as defined in claim 1, further comprising a first release paper adhered to a skin side adhesive surface of the adhesive layer, wherein the first release paper is removable to expose the skin side adhesive surface of the adhesive layer so as to fit the wig on the human skin.

10. The disposable wig as defined in claim 9, wherein a second release paper is adhered to a base side adhesive surface of the adhesive layer, and wherein the second release paper is removable to adhere the base side adhesive surface of the adhesive layer to the entire underside of the base so as to form the adhesive layer on the entire underside of the base.

11. The disposable wig as defined in claim 1, wherein the base is deformed into a substantially rugged sheet when the wig is fitted onto the human skin.

12. The disposable wig as defined in claim 1, wherein the uniform thickness of the adhesive layer and a height of the projected portions are on the order of microns (μ).

13. The disposable wig as defined in claim 1, wherein, when the wig is not fitted onto the human skin, an underside of the adhesive layer, which is formed on the entire underside of the base, is substantially rugged.

14. The disposable wig as defined in claim 1, wherein, when the wig is fitted onto the human skin, an underside of the adhesive layer, which is formed on the underside of the base, becomes substantially flat.

* * * * *